US007028372B2

(12) United States Patent
Eui-Su

(10) Patent No.: US 7,028,372 B2
(45) Date of Patent: Apr. 18, 2006

(54) DOOR HINGE MOUNTING DEVICE FOR MICROWAVE OVEN

(75) Inventor: Jung Eui-Su, Changwon Gyeongnam (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/321,606

(22) Filed: Dec. 18, 2002

(65) Prior Publication Data

US 2003/0229967 A1 Dec. 18, 2003

(30) Foreign Application Priority Data

Jun. 18, 2002 (KR) ..... 2002-34120

(51) Int. Cl.
*E05D 1/00* (2006.01)

(52) U.S. Cl. ..... 16/221

(58) Field of Classification Search ..... 16/221, 16/225, 232, 250, 357, 360

See application file for complete search history.

(56) References Cited

U.S. PATENT DOCUMENTS

| | | | | |
|---|---|---|---|---|
| 2,805,661 | A * | 9/1957 | Pollock | 126/194 |
| 5,726,427 | A * | 3/1998 | Hwang | 219/739 |
| 6,025,581 | A * | 2/2000 | Kang et al. | 219/739 |
| 6,582,036 | B1 * | 6/2003 | Alexander et al. | 312/326 |

FOREIGN PATENT DOCUMENTS

| | | | |
|---|---|---|---|
| GB | 0 823830 | * | 2/1998 |
| JP | 60-200028 | * | 10/1985 |
| JP | 04-12492 | * | 1/1992 |
| JP | 08-178304 | * | 7/1996 |
| JP | 08-219468 | * | 8/1996 |
| JP | 2000-227228 | * | 8/2000 |
| JP | 2001-223071 | * | 8/2001 |
| KR | 100254603 | | 2/2000 |

* cited by examiner

*Primary Examiner*—Chuck Y. Mah
*Assistant Examiner*—Andre' L. Jackson
(74) *Attorney, Agent, or Firm*—Fleshner & Kim, LLP

(57) ABSTRACT

A door hinge mounting device is provided for a microwave oven, which is constructed such that when a hinge plate provided in a main body of the microwave oven and a hinge shaft provided in a door of the microwave oven are hingedly connected to each other, a supporting rib supports the hinge plate so that the hinge plate cannot be lowered. Further, the supporting rib is integrally formed on a choke cover is constructed such that one end thereof is connected to the choke cover and the other end thereof is formed as a free end. The supporting rib constructed as such has a predetermined elastic force depending on the material and shape, and thus, the free end of the supporting rib tends to move toward the hinge shaft, that is, a position where the hinge plate can be supported by the supporting rib. With this construction, the door can be firmly mounted to the main body of the microwave oven without any additional components.

18 Claims, 3 Drawing Sheets

DOOR HINGE MOUNTING DEVICE FOR MICROWAVE OVEN

BACKGROUND OF THE INVENTION

1. Field of the Invention

The present invention relates to a microwave oven, and more particularly, to a door hinge mounting device for a microwave oven which is constructed such that a door cannot be inadvertently and easily detached from a door hinge.

2. Description of the Prior Art

A door is installed at an open front face of a cooking chamber. Such a door is pivotally moved with respect to a front face of a main body of the microwave oven by means of a hinge device so that the cooking chamber can be opened or closed.

As shown in FIGS. 1 and 2, a choke cover 12 is attached to the back of a door 10. The choke cover 12 serves to cover a choke structure (not shown) for preventing leakage of electromagnetic waves toward the exterior of the microwave oven so that the choke structure cannot be exposed to the rear side of the microwave oven. A corner portion at an upper side of the choke cover 12 is partially cut away so that a hinge plate 22 provided in a main body 20 of the microwave oven can be coupled to a hinge shaft h at one side of the interior of the door 10. Thus, a mounting space 13 within which the hinge plate is mounted to the hinge shaft is defined at a portion of the back of the door 10 corresponding to the partially cut-away portion of the choke cover 12.

Thus, the hinge plate 22 is inserted into the mounting space 13 within the back of the door 10 through the partially cut-away portion and pivotally coupled to the hinge shaft h. Further, a cap 14 for preventing the hinge plate from being detached from the hinge shaft is fitted and coupled into an opening of the mounting space 13. In a state where the detachment preventing cap 14 is coupled, the door 10 cannot be lifted upward, and thus, the door 10 cannot be substantially detached from but pivotally supported by the main body 20 of the microwave oven.

However, the conventional door hinge mounting device for the microwave oven has the following disadvantages.

Since the conventional door hinge mounting device includes the detachment preventing cap 14 as a separate component, the door 10 may be easily detached from the main body 20 of the microwave oven when the detachment preventing cap 14 is removed or lost. The reason is that the mounting space 13 between the bottom of the hinge plate 22 and the choke cover 12 is formed to be relatively large.

Further, since the detachment preventing cap 14 is formed separately from the choke cover 12, the cap 14 must be separately assembled. Thus, there are problems in that the number of the assembling processes is increased and efficiency of the assembly work is lowered.

SUMMARY OF THE INVENTION

The present invention is contemplated to solve the above problems in the prior art. Accordingly, an object of the present invention is to provide a simple door hinge mounting device for a microwave oven for preventing a door from being inadvertently detached from a main body of the microwave oven.

Another object of the present invention is to enhance efficiency of assembly work for a door hinge of a microwave oven.

According to an aspect of the present invention for achieving the above objects, there is provided a door hinge mounting device for a microwave oven, which comprises at least one hinge plate provided at a main body of the microwave oven for supporting a door and functioning as a pivot center of the door; a choke cover installed at the back of a door frame of the door so that a mounting space into which the hinge plate is inserted is defined at a portion of the choke cover corresponding to the hinge plate; and a supporting rib placed between the hinge plate and the choke cover for supporting the hinge plate upwardly in a state where the hinge plate is inserted into the mounting space to allow the door to be pivotally supported.

Preferably, the supporting rib is configured such that one end thereof is connected to the choke cover whereas the other end thereof is formed as a free end.

More preferably, the supporting rib has a predetermined elastic force depending on materials and shapes thereof, and the free end of the supporting rib exhibits a tendency to move toward a hinge plate supporting position by means of its own elastic force in a state where the hinge plate is inserted into the mounting space and hingedly connected to the door frame.

In addition, the supporting rib may be configured such that the degree of movement of the free end thereof is restricted by a hinge shaft coupled to the hinge plate.

Furthermore, the hinge plate is provided at each of upper and lower ends on one side of a front face of the main body of the microwave oven.

According to the present invention, therefore, there is an advantage in that the relatively simple door hinge mounting device for the microwave oven can allow the door not to be inadvertently detached from the main body of the microwave oven.

BRIEF DESCRIPTION OF THE DRAWINGS

The above and other objects, advantages and features of the present invention will become apparent from the following description of a preferred embodiment given in conjunction with the accompanying drawings, in which.

DETAILED DESCRIPTION OF THE INVENTION

Hereinafter, a preferred embodiment of a door hinge mounting device for a microwave oven according to the present invention will be explained with reference to the accompanying drawings.

Figure 1:
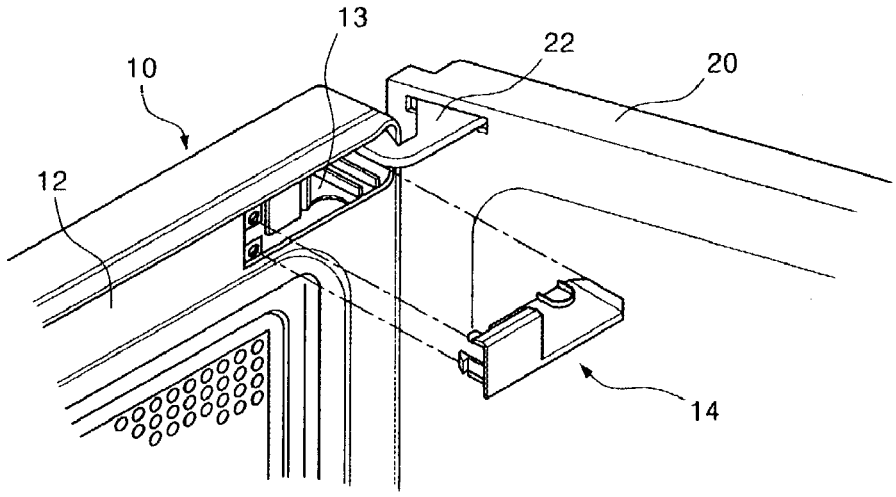
FIG. 1 is an exemplary perspective view of a conventional door hinge mounting device.
Figure 2:
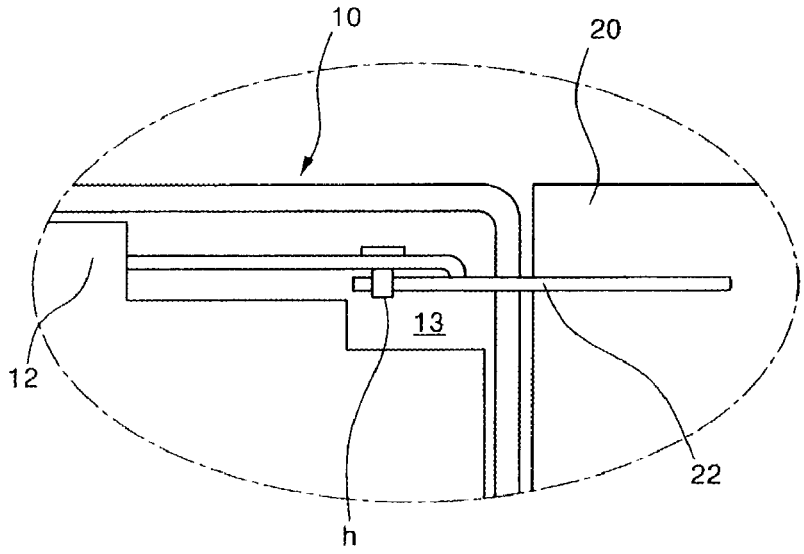
FIG. 2 is a rear view showing the constitution of the conventional door hinge mounting device viewed from the back of a door.
Figure 3:
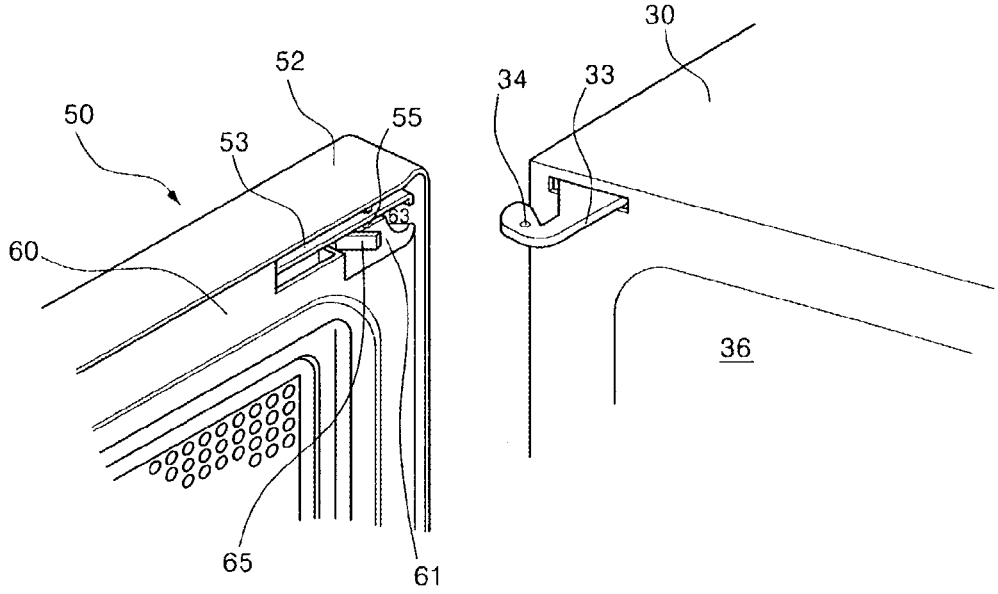
FIG. 3 is an exploded perspective view showing the constitution of a door hinge mounting device according to a preferred embodiment of the present invention.
Figure 4:
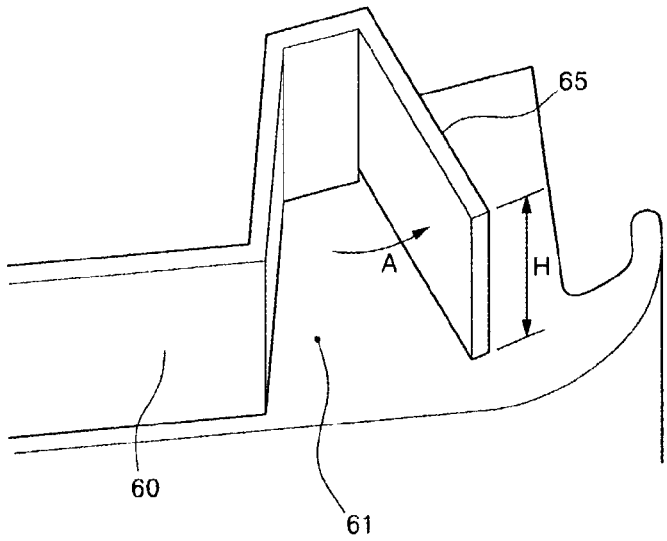
FIG. 4 is a partial perspective view showing the constitution of a choke cover and a supporting rib according to the preferred embodiment of the present invention.

FIG. 3 is an exploded perspective view of the preferred embodiment of the door hinge mounting device for the microwave oven according to the present invention, and FIG. 4 is a perspective view showing that a supporting rib is formed at a choke cover according to the preferred embodiment of the present invention.

As shown in the figures, hinge plates 33 are provided at upper and lower ends on one side of a front face of a main body 30 of a microwave oven, respectively. Each of the hinge plates 33 is formed with a hinge hole 34. Alternatively, at least one hinge plate may be provided with a hinge shaft, depending on design conditions. The hinge plate 33 is hingedly coupled with a door 50 to be described later so that a cooking chamber 36 defined within the main body 30 can be selectively opened or closed due to pivoting of the door 50.

In addition, the constitution of the door 50 will be explained. A front surface of the door 50 is defined by a front panel 52. A door frame 53 is provided on a rear surface of the front panel 52 of the door. The door frame 53 constitutes the skeleton of the door 50 and includes a choke structure for preventing leakage of electromagnetic waves by enclosing peripheral edges of the door. A protruding portion of the door frame 53, which faces and corresponds to the hinge plate 33, extends further from the door frame 53, and is provided with the hinge shaft 55 at a leading end thereof.

A choke cover 60 for covering the choke structure is provided along the peripheral edges of the door frame 53. The choke cover 60, which is generally molded, is formed separately from the door frame 53 and installed at the rear surface of the front panel 52. A portion of the choke cover 60 corresponding to the hinge plate 33 is formed such that its top surface 61 can be stepped. A mounting space 63 is defined between the top surface 61 of the choke cover 60 and the protruding portion with the hinge shaft 55 provided thereon. The hinge plate 33 is inserted into the mounting space 63.

Furthermore, a supporting rib 65 is provided on the stepped top surface 61 of the choke cover 60. As best shown in FIG. 4, one end of the supporting rib 65 is connected to the choke cover while the other end thereof is formed as a free end. In other words, the supporting rib 65 extends further from an end of the choke cover 60 in such a manner that the supporting rib is connected at only one end thereof to the end of the choke cover 60 while it is separated from the top surface 61 of the choke cover 60.

In addition, the supporting rib 65 has a predetermined elastic force depending on materials and shapes thereof That is, the free end of the supporting rib 65 tends to move with respect to the one end connected to the choke cover 60 in a direction of an arrow A shown in FIG. 4 by means of the restoring elastic force.

The supporting rib 65 causes a bottom surface of the hinge plate 33 to be held up and the hinge plate 33 not to move down into the mounting space 63 in a state where the hinge plate 33 is hingedly connected to the hinge shaft 55. Of course, the supporting rib 65 can be elastically deformed. Thus, when the hinge plate 33 is to be inserted into the mounting space 63 and coupled to the hinge shaft 55, the supporting rib 65 should be prevented from being placed below the hinge plate 33.

In a case where the hinge plate 33 is inserted into the mounting space 63 and hingedly connected to the hinge shaft 55, a height H of the supporting rib 65 should be sized not to be greater than a distance between the hinge plate 33 and the top surface 61 of the choke cover 60.

Hereinafter, the operation of the door hinge mounting device for the microwave oven according to the present invention constructed as such will be explained.

As shown in FIG. 4, the free end of the supporting rib 65 exhibits a tendency to move with respect to the one end connected to the choke cover 60 in the direction of the arrow A.

Thus, in a state where the hinge shaft 55 is inserted into the hinge hole 34 of the hinge plate 33, i.e. the door 50 is mounted to the main body 30, the hinge plate 33 is held up by the supporting rib 65 so that the hinge shaft 55 cannot be removed from the hinge hole 34.

Furthermore, if the hinge shaft 55 is to be coupled to or separated from the hinge plate 33, the supporting rib 65 should not be placed below the hinge plate 33. That is, as shown in FIG. 5*b*, the hinge connection of the hinge shaft 55 to the hinge plate 33 should be made only when the supporting rib 65 is deviated from below the hinge plate 33. To this end, an additional tool such as a screwdriver or a rod may be used.

More specifically, the free end of the supporting rib 65 is pushed in a direction opposite to the direction of the arrow A shown in FIG. 4 by using the additional tool such as the screwdriver or rod so that the supporting rib 65 can be resiliently moved against its own elastic force. If the supporting rib 65 becomes in a state shown in FIG. 5*b* due to the push action, the supporting rib 65 is not placed below the hinge plate 33 any longer. Thus, the hinge plate 33 can be moved toward the top surface 61 of the choke cover 60 within the mounting space 63 (in fact, the door 50 can be lifted).

Figure 5A:
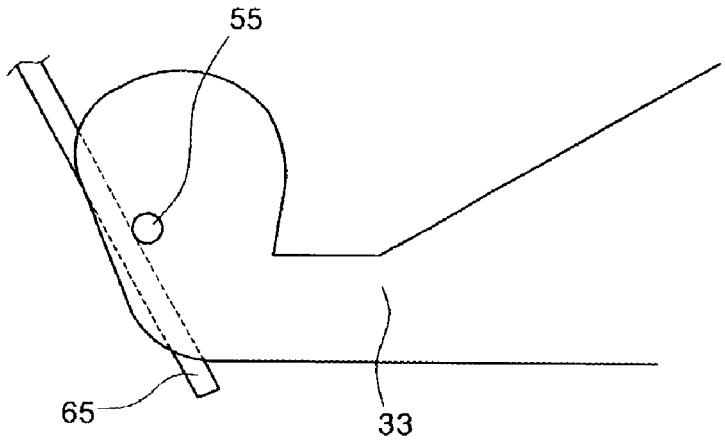
FIGS. 5*a* and 5*b* are operational views showing a positional relationship between the supporting rib and a hinge plate in the preferred embodiment of the present invention.
Figure 5B:
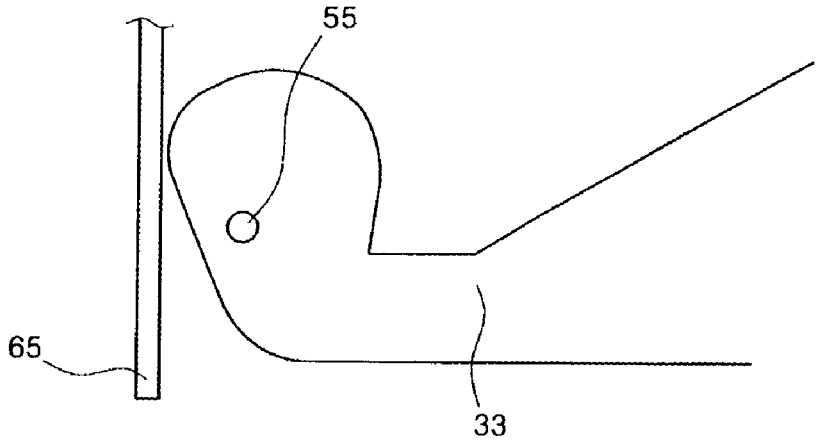

In the meantime, if any external forces are not exerted on the supporting rib 65 in a state where the hinge shaft 55 of the door 50 is hingedly connected to the hinge plate 33, the supporting rib 65 is brought into a state shown in FIG. 5*a*. At this time, the supporting rib 65 comes into contact with the hinge shaft 55 due to its own elastic force. Here, the supporting rib 65 cannot be further moved due to its contact with the hinge shaft 55. Thus, the hinge shaft 55 also functions as a stopper for restricting the movement of the supporting rib 65.

In such a state, the supporting rib 65 is placed below the hinge plate 33 and prevents the hinge plate 33 from being lowered toward the top surface 61 of the choke cover 60. Therefore, so long as the supporting rib 65 is deviated from below the hinge plate 33 due to the additional external force exerted thereon, the hinge plate 33 can be prevented from being lowered. Accordingly, the door 50 cannot be inadvertently detached from the main body 30 of the microwave oven.

As specifically described above, the door hinge mounting device for the microwave oven according to the present invention is constructed such that the hinge plate is supported by the supporting rib within the mounting space in a state where it is hingedly connected to the hinge shaft of the door. Thus, the supporting rib restricts the movement of the hinge plate to a certain extent that the hinge shaft cannot be removed from the hinge plate. Accordingly, only the supporting rib integrally formed on the choke cover can cause the door to be firmly secured to the main body of the microwave oven without any additional components so that more reliable door hinge mounting device can be provided.

Further, there is no risk of losing the supporting rib since the supporting rib is integrally formed on the choke cover. Since the separate detachment preventing cap need not be used, the number of parts is reduced. Thus, workability of the assembly work can be relatively enhanced and production costs can be reduced.

It will be understood by those skilled in the art that various changes and modifications may be made to the present invention without departing from the spirit and scope of the present invention. It is apparent that the scope of the present invention should be construed based on the accompanying claims.

What is claimed is:

1. A door hinge mounting device for a microwave oven, comprising:

at least one hinge plate configured to be attached to a main body of the microwave oven and to support a door, functioning as a pivot center of the door;

a choke cover installed on a back of the door and accommodating a mounting space into which the hinge plate is configured to be inserted at a portion of the choke cover corresponding to the hinge plate; and a supporting rib configured to be positioned between the hinge plate and the choke cover and to support the hinge plate in a support position in which the hinge plate is inserted into the mounting space and held substantially fixed in place by the supporting rib such that the door is pivotally supported, wherein the supporting rib is in the form of a flexible, substantially planar member which extends from the choke cover and which is bent at one or more places along a length thereof, and wherein the supporting rib is elastically deformed in the support position.

2. The device as claimed in claim 1, wherein the hinge plate is provided at each of upper and lower ends on one side of a front face of the main body of the microwave oven.

3. The device as claimed in claim 1, wherein the supporting rib is in the form of a substantially planar member which extends from the choke cover and which is bent at two or more places as to form a u-shape.

4. A microwave oven comprising the door hinge mounting device of claim 1.

5. The device as claimed in claim 1, wherein the supporting rib is configured such that one end thereof extends from the choke cover whereas the other end thereof is formed as a free end.

6. The device as claimed in claim 5, wherein the supporting rib has a predetermined elastic force and the free end of the supporting rib exhibits a tendency to move toward the support position by means of its own elastic force in a state in which the hinge plate is inserted into the mounting space and hingedly connected to the door.

7. The device as claimed in claim 5, wherein the supporting rib is configured such that the degree of movement of the free end thereof is restricted by a hinge shaft coupled to the hinge plate.

8. A door hinge mounting device for a microwave oven that includes a main body and a door mounted on the main body, comprising:

at least one hinge plate attached to the main body of the microwave oven, wherein the hinge plate includes a pivot hole; and a supporting rib coupled to a mounting space on the door, wherein the mounting space is configured to receive the hinge plate when the door is mounted on the main body, and wherein a pin in the mounting space on the door is configured to be inserted into the pivot hole of the hinge plate such that the door is pivotally mounted on the main body, and wherein the supporting rib is elastically movable between a first position which prevents the pin from being removed from the pivot hole and a second position which allows the pin to be removed from the pivot hole, and wherein when the supporting rib is in the first position, the supporting rib contacts the pin.

9. A microwave oven comprising the door hinge mounting device of claim 8.

10. The door hinge mounting device of claim 8, wherein the hinge plate and pin are configured such that the pin is inserted into the top of the pivot hole.

11. The door hinge mounting device of claim 10, wherein when the supporting rib is in the first position, at least an end portion of the supporting rib is located underneath the hinge plate to thereby prevent the door from being moved upward relative to the hinge plate to remove the pin from the pivot hole.

12. The door hinge mounting device of claim 11, wherein when the supporting rib is in the second position, the end portion of the supporting rib does not prevent the door from being moved upward relative to the binge plate, thereby allowing the pin to be removed from the pivot hole.

13. The door hinge mounting device of claim 12, wherein the end portion of the supporting rib can be elastically moved to the second position.

14. The door hinge mounting device of claim 8, wherein the supporting rib comprises a thin flexible member that is movable between the first and second positions.

15. The door binge mounting device of claim 14, wherein the supporting rib is configured as a U-shaped flexible member.

16. The door hinge mounting device of claim 15, wherein an end portion of the U-shaped flexible member is movable between the first and second positions.

17. The door hinge mounting device of claim 15, wherein the hinge plate and pin are configured such that the pin is inserted into the top of the pivot hole, and wherein when the end portion of the U-shaped flexible member is in the first position, the end portion is located underneath the hinge plate to thereby prevent the door from being moved upward relative to the hinge plate to remove the pin from the pivot hole.

18. The door hinge mounting device of claim 17, wherein when the end portion of the U-shaped flexible member is in the second position, the end portion does not prevent the door from being moved upward relative to the hinge plate, thereby allowing the pin to be removed from the pivot hole.

* * * * *